US005669210A

United States Patent [19]

Völlmecke et al.

[11] Patent Number: 5,669,210

[45] Date of Patent: Sep. 23, 1997

[54] HORSE BRIDLE BITS AND METHOD OF MANUFACTURING AND USING SAME

[75] Inventors: Valentin Völlmecke; Heinz Baumann, both of Iserlohn, Germany

[73] Assignee: Herm, Sprenger GmbH & Co. KG, Iserlohn, Germany

[21] Appl. No.: 557,970

[22] Filed: Nov. 13, 1995

Related U.S. Application Data

[63] Continuation-in-part of Ser. No. 285,195, Aug. 3, 1994, abandoned.

[30] Foreign Application Priority Data

Aug. 7, 1993 [DE] Germany ..... 43 26 550.2

[51] Int. Cl.[6] ..... B68B 1/06

[52] U.S. Cl. ..... 54/8

[58] Field of Search ..... 54/7, 8, 9; 420/477

[56] References Cited

U.S. PATENT DOCUMENTS

| | | | |
|---|---|---|---|
| 1,924,581 | 8/1933 | Wilkins | 420/477 X |
| 2,075,005 | 3/1937 | Bassett | 420/477 |
| 2,421,173 | 5/1947 | Ulrich | 54/7 X |
| 3,750,368 | 8/1973 | Hyland | 54/8 |
| 4,751,049 | 6/1988 | Shannon | 420/477 |

*Primary Examiner*—Robert P. Swiatek

*Attorney, Agent, or Firm*—Collard & Roe, PC

[57] ABSTRACT

A copper alloy for bridle bits and similar items including 81–88%, by weight, of copper, less than 4%, by weight, of silicon, and the remainder zinc including impurities. The alloy is characterized by high strength and readily stimulates the horse to chew on the bit. The lack of nickel in the alloy is also safer for the horses. A method of manufacturing including casting the bridle bit from the copper alloy. A method of using the bridle bit includes casting the bridle bit, placing it into a horse's mouth, stimulating the horse to quick chewing on the bridle bit and controlling the horse's pace and speed due to the stimulation to quick chewing.

14 Claims, No Drawings

HORSE BRIDLE BITS AND METHOD OF MANUFACTURING AND USING SAME

CROSS-REFERENCE TO RELATED APPLICATION

This is a continuation-in-part Application of U.S. patent application Ser. No. 08/285,195 filed on Aug. 3, 1994, and now abandoned.

BACKGROUND OF THE INVENTION

1. Field of the Invention

The present invention relates to a shaped article in the form of a horse bridle bit and method of manufacturing and using same.

2. The Prior Art

Previously, bridle bits or bit bars were cast from copper alloys. The copper or oxides, which are formed, or other compounds stimulate the horses to chew. This makes it easier for the rider to control the horse, including changing the horse's pace and speed.

Silver alloys with a high copper content are also used for bridle bits which normally have a copper content of 50–70%, by weight, combined with 13–25%, by weight, zinc and a relatively high nickel content of 12–16%, by weight. The desired increase in the copper contents leads to a considerable decrease in the strength of the alloy such that it can no longer be used as a bit bar since they are subject to stress.

SUMMARY OF THE INVENTION

It is, therefore, an object of the present invention to overcome the drawbacks of the prior art and to provide a copper alloy for bridle bits having a high copper content and being at least as strong as the previously used silver alloys.

It is a further object of the present invention to provide a copper alloy for bridle bits which is free of heavy metals.

These and other related objects are achieved according to the invention by a shaped article adapted for placement into a horses mouth comprising a bridle bit consisting of 81–88% copper, less than 4% silicon and the balance being zinc including impurities. All percentages are on the basis of weight. The bridle bit is devoid of nickel and heavy metals. The bridle bit is adapted for placement into the horse's mouth, wherein the horse is stimulated to quick chewing so that the horse's pace and speed is better controlled. Alternatively, the bridle bit consists of 83–86% copper, 2.5–3.7% silicon and 10–13% zinc. Alternatively, the shaped article consists essentially of a bridle bit consisting essentially of 83–86% copper, 2.5–3.7% silicon and 10–13% zinc. In a further embodiment, the bridle bit consists essentially of 81–88% copper, less than 0.1% silicon and the remainder being zinc, including impurities.

The invention also relates to a method for manufacturing a bridle bit from a copper alloy for placement into a horse's mouth. The improvement comprises producing a bridle bit from a copper alloy consisting essentially of 81–88% copper, less than 4% silicon and the remainder being zinc including impurities. The bridle bit is devoid of nickel and heavy metals. Alternatively, the copper alloy consists essentially of 83–86% copper, 2.5–3.7% silicon and 10–13% zinc. In a further embodiment, the copper alloy consists essentially of 81–88% copper, less than 0.1% silicon and the remainder being zinc including impurities. The bridle bit is cast from the copper alloy.

The method further comprises the steps of placing the bridle bit into a horse's mouth wherein the horse is stimulated to quick chewing so that the horse's pace and speed is better controlled. The method also includes the steps of stimulating the horse to quick chewing by placing said bridle bit into the horse's mouth, so that the horse's pace and speed is better controlled. Alternatively, the method includes the step of controlling the horse's pace and speed by placing the bridle bit into the horse's mouth wherein the horse is stimulated to quick chewing. The method also includes the additional steps of placing the bridle bit into the horse's mouth, stimulating the horse to quick chewing on the bridle bit, and controlling the horse's pace and speed due to the stimulation to quick chewing.

DETAILED DESCRIPTION OF PREFERRED EMBODIMENTS

The copper alloy, according to the invention, consists of 81–88%, by weight, copper, less than 4%, by weight, silicon, and the remainder being zinc including impurities. For example, silicon may be present at less than 0.1%, by weight. This alloy has sufficient strength for its intended use. The alloy is accepted well by the horse in the form of a bit bar or similar item. Upon placement into the horse's mouth, the horse is stimulated to quick chewing.

A further embodiment of the copper alloy includes 83–86%, by weight, copper, 2.5–3.7%, by weight, silicon, and 10–13%, by weight, zinc. The copper alloy is superior to currently used alloys due to the distinctly higher copper content. It is also important to know that the alloy does not include nickel and is, therefore, better for the animal's health.

While several embodiments of the present invention have been shown and described, it is to be understood that many changes and modifications may be made thereunto without departing from the spirit and scope of the invention as defined in the appended claims.

What is claimed is:

1. A shaped article adapted for placement into a horse's mouth comprising:

a bridle bit consisting of:

81–88%, by weight, of copper;

less than 4%, by weight, of silicon; and zinc including impurities;

said bridle bit being devoid of nickel and heavy metals;

said bridle bit being adapted for placement into a horse's mouth wherein the horse is stimulated to quick chewing so that the horse's pace and speed are better controlled.

2. The shaped article according to claim 1, wherein said bridle bit consists of:

83–86%, by weight, of copper;

2.5–3.7%, by weight, of silicon; and

10–13%, by weight, of zinc.

3. The shaped article according to claim 1, wherein the shaped article consists essentially of a bridle bit consisting essentially of:

83–86%, by weight, of copper;

2.5–3.7%, by weight, of silicon; and

10–13%, by weight, of zinc.

4. The shaped article according to claim 1, wherein said bridle bit consists essentially of:

81–88%, by weight, of copper;

less than 0.1%, by weight, of silicon; and zinc including impurities.

5. In a method for manufacturing a bridle bit from a copper alloy for placement into a horse's mouth, the improvement which comprises:

producing a bridle bit from a copper alloy consisting essentially of:

81–88%, by weight, of copper;

less than 4%, by weight, of silicon; and zinc including impurities; said bridle bit being devoid of nickel and heavy metals.

6. The method according to claim 5, wherein said copper alloy consists essentially of:

83–86%, by weight, of copper;

2.5–3.7%, by weight, of silicon; and

10–13%, by weight, of zinc.

7. The method according to claim 5, wherein said copper alloy consists essentially of:

81–88%, by weight, of copper;

less than 0.1% by weight, of silicon; and zinc including impurities.

8. The method according to claim 5, which comprises:

casting said bridle bit from said copper alloy.

9. The method according to claim 8, further comprising the steps of:

placing said bridle bit into a horse's mouth wherein the horse is stimulated to quick chewing so that the horse's pace and speed are better controlled.

10. The method according to claim 8, further comprising the steps of:

stimulating a horse to quick chewing by placing said bridle bit into the horse's mouth, so that the horse's pace and speed are better controlled.

11. The method according to claim 8, further comprising the steps of:

controlling a horse's pace and speed by placing said bridle bit into the horse's mouth wherein the horse is stimulated to quick chewing.

12. The method according to claim 8, further comprising the steps of:

placing said bridle bit into a horse's mouth;

stimulating the horse to quick chewing on said bridle bit, and controlling the horse's pace and speed due to said stimulation to quick chewing.

13. In a method for using a bridle bit manufactured from a copper alloy for placing into a horse's mouth, the improvement comprising providing a bridle bit cast from a copper alloy consisting essentially of 83–86%, by weight, of copper, 2.5–3.7%, by weight, of silicon, and 10–13%, by weight, of zinc, said bridle bit being devoid of nickel and heavy metals;

placing said bridle bit into a horse's mouth;

stimulating the horse to quick chewing on the bridle bit; and controlling the horse's pace and speed due to said stimulation to quick chewing.

14. The method according to claim 13, wherein said copper alloy consists essentially of less than 0.1%, by weight, of silicon.

* * * * *